United States Patent [19]

Hauman, Jr.

[11] 4,047,885

[45] Sept. 13, 1977

[54] ROTATING WICK OIL DISPENSING SYSTEM

[75] Inventor: Dewey H. Hauman, Jr., Palmyra, N.Y.

[73] Assignee: Xerox Corporation, Stamford, Conn.

[21] Appl. No.: 690,212

[22] Filed: May 26, 1976

[51] Int. Cl.[2] ..... F27B 9/28

[52] U.S. Cl. ..... 432/60; 118/60; 118/262

[58] Field of Search ..... 118/60, 70, 104, 203, 118/264, 266, 262; 432/59, 60, 75, 228

[56] References Cited

U.S. PATENT DOCUMENTS

| | | | |
|---|---|---|---|
| 2,368,759 | 2/1945 | Haessler | 118/203 |
| 2,589,966 | 3/1952 | Rullo | 118/203 X |
| 3,861,863 | 1/1975 | Kudsi | 432/60 |

*Primary Examiner*—Dorsey Newton

[57] ABSTRACT

A contact fuser assembly for use in an electrostatic reproducing apparatus including an internally heated metal core cooperating with a resilient backup roll to form a nip through which substrates carrying toner images are moved with the toner images contacting the metal core. The fuser assembly is characterized by the provision of a sump of liquid release agent material which material is provided for coating the surface of the fuser roll structure. In order to apply the liquid release agent material to the surface of the fuser roll structure there is provided a cylindrical applicator member which is partially submersed in the release agent material. A ratchet wheel and pawl arrangement is provided for periodically indexing or moving the applicator member in response to disengagement of the backup roll from the fuser roll through pivoting of an arm supporting the backup roll. To this end, the pawl member is pivotably supported by the pivot arm and actuates the ratchet wheel each time the pivot arm is moved for effecting disengagement of the backup roll from the fuser roll.

8 Claims, 1 Drawing Figure

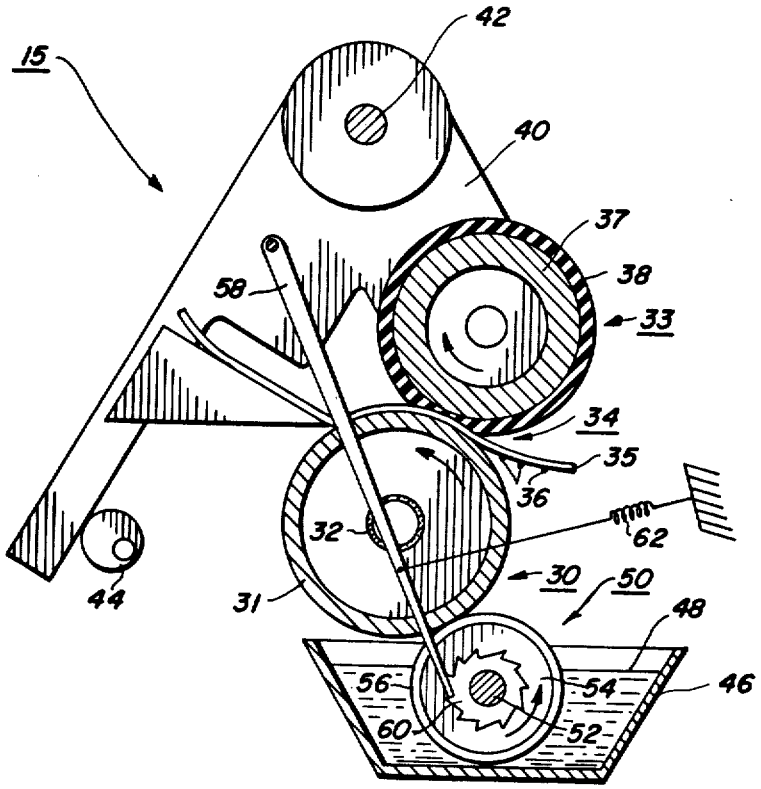
15
42
40
37
38
33
58
34
35
36
32
62
30
50
44
31
48
56
54
46
60
52

ROTATING WICK OIL DISPENSING SYSTEM

BACKGROUND OF THE INVENTION

This invention relates generally to a xerographic copying apparatus and, more particularly, to a contact fusing system employing a cylindrical member partially immersed in a sump of release agent material for applying the release agent material to the surface of the heated fuser roll structure.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the heated roll to thereby effect heating of the toner images within the nip, pressure being applied to said rolls to thereby effect said nip. By controlling the heat transfer to the toner, virtually no offset of toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquefy and cause a splitting action in the toner to thereby result in hot offset. Splitting occurs when the cohesive forces holding the viscous toner mass together are less than the adhesive forces tending to offset it to a contacting surface such as a fuser roll.

However, toner particles will be offset to the fuser roll by an insufficient application of heat to the surface thereof (i. e. "cold" offsetting) by imperfections in the properties in the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils, which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus, a low surface energy layer is presented to the toner as it passes through the fuser nip and thereby prevents toner from offsetting to the fuser roll surface.

The foregoing notwithstanding, "non-visual offsetting" (i.e. offsetting of very fine particles of toner) does occur. In prior art constructions (fuser structures where the outer surface comprises Teflon or silicone rubber) such offsetting has been combated by the employment of various cleaning members, the wick material employed for applying silicone based oil to the fuser roll serving this purpose.

It has been found that cleaning systems which are known to work with low to medium speed reproducing apparatus falls short of accomplishing the desired results in high speed machines.

It is a primary object of the present invention to improve the structure employed for applying release agent material to a roll fuser member and for removing toner and other contaminants therefrom.

BRIEF SUMMARY OF THE INVENTION

Briefly, the objects of the invention are accomplished by the provision of a contact fuser apparatus comprising a roll fuser structure cooperating with a resilient backup or pressure roll to form a nip through which substrates carrying toner images are passed with the toner images contacting the fuser roll structure.

A sump of release agent material, preferably 100 cs. silicone oil, is provided for coating the fuser roll structure to enhance the release of toner particles and other contaminants from the surface of the fuser roll structure.

The sump of release agent material is supported below the fuser roll structure and a cylindrically shaped applicator member is supported therein such that it is immersed partially in the silicone oil. The cylindrically shaped applicator structure is provided with a ratchet member which is adapted to be actuated by means of a pawl which is pivotably supported by a pivot arm which supports the backup or pressure roll for engagement and disengagement with the fuser roll structure. A cam is provided which effects disengagement and engagement of the pressure roll with the fuser roll with simultaneous actuation of the pawl and ratchet mechanism with disengagement to incrementally rotate the applicator roll such that a new portion of the surface thereof is presented to the surface of the fuser roll structure to thereby provide a clean applicator surface to the fuser roll structure.

By the provision of the foregoing arrangement for actuating the applicator structure, expensive mechanisms such as a motor drive can be eliminated and the applicator life can be substantially increased and a overall performance of the fuser improved.

Other objects and advantages of the present invention will become apparent when read in conjunction with the accompanying drawing.

DESCRIPTION OF THE DRAWING

The FIGURE represents a schematic side elevational view of a contact fuser representing the invention.

DETAILED DESCRIPTION OF THE PREFERRED EMBODIMENT

Since the xerographic reproducing process is well known, a detailed description thereof is omitted. For those who would consider a description of the xerographic process necessary for a complete understanding of the present invention reference may be had to U.S. Pat. Nos. 3,718,116 and 3,745,972.

As shown in the FIGURE, the present invention comprises a fuser assembly 15 including a heated roll structure 30 including a hollow cylinder or core 31 having a suitable heating element 32 disposed in the hollow portion thereof which is coextensive with the cylinder or core. The heating element 32 may comprise any suitable type heater for elevating the surface temperature of the cylinder to operational temperatures, therefore, 250°–400° F. For example, it may be a quartz lamp. The cylinder or core 31 is fabricated from any suitable material capable of accomplishing the objects of the present invention. Typical materials are copper, anodized aluminum, and alloys thereof, steel, stainless steel, and alloys thereof, nickel plated copper and chrome-plated copper. The resulting structure has an outside diameter on the order of 1.5 to 3.0 inches and has a length on the order of 10 to 15 inches. Power requirements for the foregoing are 500–2500 watts peak power with an average power of 300–2000 watts and 75–600 watts for standby.

The surface temperature of the fuser roll structure may be controlled by contacting the surface thereof with a thermistor probe (not shown) in a manner described in U.S. Pat. No. 3,327,096 issued in 1967 to Bernous and incorporated herein by reference.

The fuser assembly 15 further comprises a backup or pressure roll structure 33 which cooperates with the fuser roll structure 30 to form a nip 34 through which a copy paper or substrate 35 passes such that toner images 36 thereon contact the fuser roll structure. The backup roll structure may comprise any suitable construction for example, a steel cylinder, but preferably comprises a rigid steel core 37 having a Viton elastomer surface or layer 38 thereon. A suitable roll has a core approximately 1.8 inches in diameter with 0.1 inch cover or layer structure of Viton elastomer or other suitable high temperature elastomeric layer structure, for example, silicone rubber and a combination of Viton and silicone rubber with Teflon thereon. Viton is a trademark of E. I. duPont de Nemours & Co. The specific dimensions of the members making up the backup roll will be dictated by the requirements of the particular copying apparatus wherein the fuser assembly 15 is employed, the dimensions being greater or less depending upon the process speed of the machine.

A substantially V-shaped support arm 40 is pivotably supported by a machine frame not shown by means of a pin 42. A cam 44 is mounted for rotation into engagement with the pivot support arm 40 to effect pressure engagement of the pressure roll 33 with the fuser roll structure 30.

This engagement serves to create nip pressures on the order of 15 to 150 psi average. The durometer of the backup roll is chosen such that "dwell times" of 5 to 40 milliseconds can be obtained with loading forces within the aforementioned range of pressures. Dwell time is proportional to the ratio of the nip length to the surface speed of the rolls. For a given angular velocity the surface speeds will vary depending upon the diameter of the rolls. For example, with a 2-inch fuser roll, speeds of 0 to 30 inches per second are obtainable and for a 3-inch fuser roll, speeds of 0 to 45 inches per second have been obtained. Accordingly, it can be seen that the aforementioned dwell times can be obtained by varying one or the other or both of the dwell time relationships. Durometers of 20–90 shore A have been found to provide satisfactory results.

The aforementioned materials from which the fuser roll structure 30 may be fabricated are relatively high surface energy materials, consequently, hot toner materials contacting such surfaces would readily wet the surface of the fuser roll. Accordingly, there is provided a sump 46 containing release agent material 48 capable of interacting with the fuser roll. The release agent material preferably comprises a polyorganosiloxane having functional mercapto groups which interact with the fuser member in such a manner as to form an interfacial barrier at the surface of the fuser member while leaving an unreacted, low surface energy release fluid as an outer layer of film. The interfacial barrier is strongly attached to the fuser member surface and prevents toner material from contacting the outer surface of the fuser member. The material on the surface of the fuser member is of minimal thickness and thereby represents a minimal thermal barrier. The type of release agent material contemplated encompasses polyorganosiloxanes which are characterized by having built-in mercapto functionality.

By the use of the term "built-in" mercapto functionality, is meant any polyorganosiloxane material which is characterized by mercapto functional groups (—SH). For a more detailed description of the type of material above described, reference may be had to U.S. patent application Ser. No. 491,412 filed July 24, 1974 and assigned to the assignee of the present application.

In order to apply the release agent material 48 to the fuser roll structure 30 there is provided a cylindrically shaped applicator member 50 which is rotatably supported such that it can be rotated relative to the fuser roll structure 30 and release agent material 48, and further such that it is partially submerged in the release agent material 48. The applicator structure 50 comprises a rigid core 52 which has a layer 54 of wick material comprising wool or Nomex which is capable of wicking a release agent material from the sump 46 to the fuser roll structure 30. A Teflon outer layer 56 which is relatively porous may be provided.

In order to effect counterclockwise incremental rotation of the applicator structure 50 a pawl 58 and ratchet 60, the former being pivotably mounted to the arm 40 and the latter being carried by the shaft or core 52. It will be appreciated that the pawl and ratchet mechanism will be actuated each time the cam 44 effects disengagement of the pressure roll 33 from the fuser roll structure 30 by virtue of the pivoting of the support arm 40. A bias spring 62 is provided for maintaining engagement between the pawl and the ratchet teeth. A one-way clutch (not shown) prevents clockwise movement of the applicator.

While the invention has been shown and described in conjunction with the preferred embodiment thereof, it will be understood that various modifications thereto may be made by those skilled in the art without departing from the spirit of the invention and such modifications are intended to be covered by the claims appended hereto. For example, while the applicator structure 50 is shown as serving to apply release agent material to the fuser roll structure 30 it will be appreciated that the application could be to the pressure roll 33 with subsequent application to the fuser roll structure 30 when the rolls rotate in contact with each other when there is no copy paper moving through the nip. Also, while the actuation of the applicator member or structure 50 is effected as shown during disengagement of the roll structures it will be appreciated that actuation thereof could be effected during engagement of the roll structures.

Moreover, while the fuser roll structure 30 has been disclosed as a metallic structure it will be appreciated that the outer surface of the fuser roll could comprise Teflon or silicone rubber or other suitable abhesive materials.

What is claimed is:

1. Roll fuser apparatus comprising:

a heated roll structure;

a pressure roll structure cooperating with said heated roll structure to form a nip through which substrates carrying toner images thereon move;

means for effecting pressure engagement of said roll structures to form said nip during fusing of said toner images and for effecting disengagement thereof when images are not being fused;

means for applying release agent material to at least one of said roll structures for minimizing the offsetting of toner thereto, said means for applying release agent material comprising an endless surface only a portion of which contacts said at least one roll structure at any given time; and means for effecting incremental movement of said release agent applying means whereby different portions of said endless surface are sequentially and periodically moved into contact with said at least one roll structure, said incremental movement effecting means being operably connected to said pressure engagement effecting means whereby movement of said release agent applying means is effected in response to actuation of said means for effecting pressure engagement and disengagement of said roll structures.

2. Apparatus according to claim 1 wherein said means for effecting engagement and disengagement of said roll structures comprises a pivot arm structure supporting said pressure roll and means for effecting pivoting of said pivot arm structure.

3. Apparatus according to claim 2 wherein said incremental movement effecting means comprises a ratchet wheel and pawl arrangement and wherein said pawl is pivotably connected to said pivot arm structure and said ratchet wheel is carried by said release agent applying means.

4. Apparatus according to claim 3 wherein said means for applying release agent material comprises a cylindrical structure comprising a rigid core having a layer of material thereon capable of containing a quantity of release agent material and wicking same to the surface of said at least one of said roll structures.

5. Apparatus according to claim 4 wherein said cylindrical structure is partially disposed in a reservoir of liquid release agent material whereby said layer of material provides communication between said release agent material and said at least one of said roll structures.

6. Apparatus according to claim 5 wherein said cylindrical structure comprises an outer layer of polytetrafluoroethylene.

7. Apparatus according to claim 6 wherein said at least one of said roll structures comprises an internal source of thermal energy for elevating the surface temperature thereof to operating temperatures.

8. Apparatus according to claim 1 wherein said incremental movement of said release agent applying means is accomplished during disengagement of said roll structures.

* * * * *